US008282507B2

(12) United States Patent
Ohama

(10) Patent No.: US 8,282,507 B2
(45) Date of Patent: Oct. 9, 2012

(54) GOLF BALL

(75) Inventor: Keiji Ohama, Kobe (JP)

(73) Assignee: SRI Sports Limited, Kobe (JP)

( * ) Notice: Subject to any disclaimer, the term of this patent is extended or adjusted under 35 U.S.C. 154(b) by 435 days.

(21) Appl. No.: 12/219,482

(22) Filed: Jul. 23, 2008

(65) Prior Publication Data

US 2009/0042671 A1 Feb. 12, 2009

(30) Foreign Application Priority Data

Aug. 8, 2007 (JP) ..... 2007-206058

(51) Int. Cl.
*A63B 37/06* (2006.01)

(52) U.S. Cl. ..... 473/373

(58) Field of Classification Search ..... 473/373, 473/374, 376

See application file for complete search history.

(56) References Cited

U.S. PATENT DOCUMENTS

| | | | | |
|---|---|---|---|---|
| 5,830,087 | A | 11/1998 | Sullivan et al. | |
| 2005/0176523 | A1 * | 8/2005 | Boehm et al. | 473/354 |
| 2006/0189413 | A1 | 8/2006 | Boehm et al. | |

FOREIGN PATENT DOCUMENTS

| | | | |
|---|---|---|---|
| JP | 9-117532 | A | 5/1997 |
| JP | 2006-223874 | A | 8/2006 |
| JP | 2006-223875 | A | 8/2006 |
| JP | 2006-230661 | A | 9/2006 |

* cited by examiner

*Primary Examiner* — Raeann Gorden

(74) *Attorney, Agent, or Firm* — Birch, Stewart, Kolasch & Birch, LLP

(57) ABSTRACT

Golf ball 2 has spherical core 4, and cover 6 provided so as to cover this core 4. The core 4 has spherical center 8, and mid layer 10 provided so as to cover this center 8.

The resilience coefficient Ec of the center 8, the resilience coefficient Em of the core 4, and the resilience coefficient Eb of the golf ball 2 satisfy the following formulae (1) and (2):

$$Eb \geqq Ec \geqq Em \quad (1);$$

$$Eb - Ec \geqq Ec - Em \quad (2).$$

The difference (Eb−Ec) between the resilience coefficient Eb and the resilience coefficient Ec is equal to or greater than 0.004. The difference (Ec−Em) between the resilience coefficient Ec and the resilience coefficient Em is equal to or greater than 0.004.

1 Claim, 2 Drawing Sheets

GOLF BALL

This application claims priority on Patent Application No. 2007-206058 filed in JAPAN on Aug. 8, 2007. The entire contents of this Japanese Patent Application are hereby incorporated by reference.

BACKGROUND OF THE INVENTION

1. Field of the Invention

The present invention relates to golf balls. More particularly, the present invention relates to multi-piece golf balls having a center, a mid layer and a cover.

2. Description of the Related Art

Flight performances are important for golf balls. The flight distance correlates with the speed of the ball immediately after the impact. This speed correlates with the resilience performance. With respect to the resilience performance, a variety of proposals have been made.

Japanese Unexamined Patent Application Publication No. 2006-223874 (US 2005/176523) discloses a golf ball having a center, a first mid layer, a second mid layer and a cover. The resilience coefficient of a spherical body including the center and the first mid layer is greater than the resilience coefficient of the center. The resilience coefficient of a spherical body including the center, the first mid layer and the second mid layer is greater than the resilience coefficient of a spherical body including the center and the first mid layer. The resilience coefficient of the golf ball is greater than the resilience coefficient of a spherical body including the center, the first mid layer and the second mid layer.

Japanese Unexamined Patent Application Publication No. 2006-223875 (US 2006/189413) discloses a golf ball having a center, a first mid layer, a second mid layer and a cover. The resilience coefficient of a spherical body including the center, the first mid layer and the second mid layer is greater than the resilience coefficient of the golf ball. The resilience coefficient of a spherical body including the center and the first mid layer is greater than the resilience coefficient of a spherical body including the center, the first mid layer and the second mid layer. The resilience coefficient of the center is greater than the resilience coefficient of a spherical body including the center and the first mid layer.

Japanese Unexamined Patent Application Publication No. 2006-230661 discloses a golf ball suitable for golf players who hit with a low head speed. This golf ball has a core, a mid layer and a cover. In this golf ball, a highly resilient material is used for the mid layer.

The resilience coefficient correlates with the rigidity of the golf ball. Highly rigid golf balls generally have a great resilience coefficient. However, when such highly rigid golf balls are hit by golf players with less power, sufficient flight distance may not be attained because the golf ball is not appropriately deformed when the golf ball is hit by the golf players with less power, i.e., golf players who hit with a low head speed.

Golf players with less power desire for improvement of the flight performances of golf balls. An object of the present invention it to provide a golf ball that is excellent in the flight performance upon hitting with a low head speed.

SUMMARY OF THE INVENTION

Golf ball according to one aspect of the present invention has a core, and a cover positioned outside this core. This core has a center, and a mid layer positioned outside this center. The resilience coefficient Ec of the center, the resilience coefficient Em of the core, and the resilience coefficient Eb of the golf ball satisfy the following formula (1):

$$Eb \geqq Ec \geqq Em \quad (1).$$

In this golf ball, the resilience coefficient Em of the core is the lowest among the resilience coefficient Ec of the center, the resilience coefficient Em of the core, and the resilience coefficient Eb of the golf ball. Appropriate distortion is generated when this golf ball is hit, even though just a low head speed is attained. This distortion allows a great flight distance to be attained.

Preferably, this golf ball further satisfies the following formula (2):

$$Eb - Ec \geqq Ec - Em \quad (2).$$

Preferably, the difference (Eb−Ec) between the resilience coefficient Eb and the resilience coefficient Ec is equal to or greater than 0.004. Preferably, the difference (Ec−Em) between the resilience coefficient Ec and the resilience coefficient Em is equal to or greater than 0.004.

The center may have a first layer, and a second layer positioned outside this first layer. Preferably, the resilience coefficient Ec1 of the first layer, and the resilience coefficient Ec of the center satisfy the following formula (3):

$$Ec > Ec1 \quad (3).$$

Preferably, this golf ball satisfies the following formula (4) or (5):

$$Eb \geqq Ec \geqq Em > Ec1 \quad (4);$$

$$Eb \geqq Ec > Em \geqq Ec1 \quad (5).$$

Preferably, the hardness (shore D) of the mid layer is less than 35.

DESCRIPTION OF THE PREFERRED EMBODIMENTS

The present invention will be hereinafter described in detail with appropriate references to the accompanying drawing, according to preferred embodiments.

Figure 1:
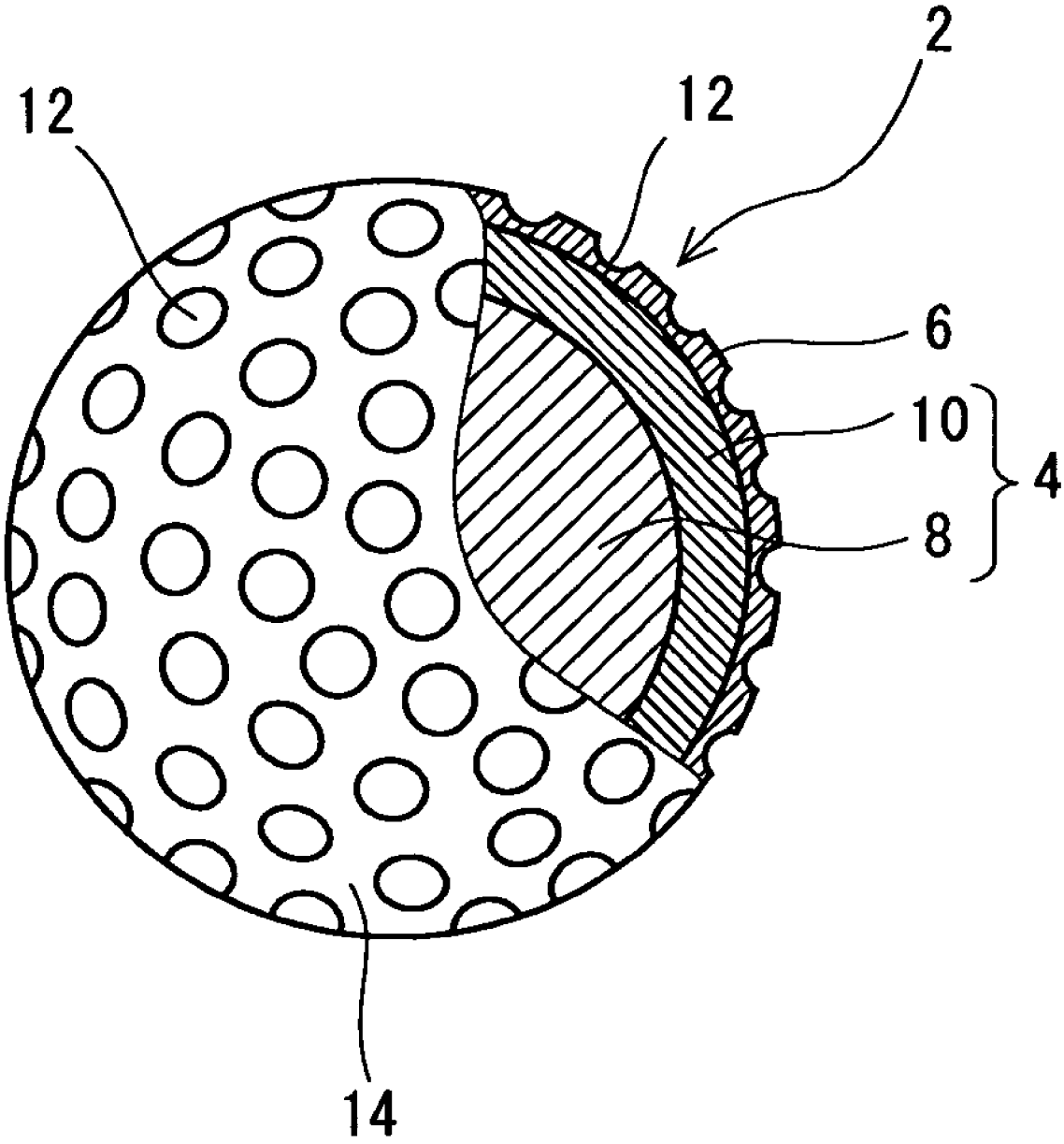
FIG. 1 shows a schematic cross-sectional view illustrating a golf ball according to one embodiment of the present invention.

Golf ball 2 shown in FIG. 1 has spherical core 4, and cover 6 provided so as to cover this core 4. The core 4 has spherical center 8, and mid layer 10 provided so as to cover this center 8. Numerous dimples 12 are formed on the surface of the cover 6. Of the surface of the golf ball 2, a part other than the dimples 12 is land 14. This golf ball 2 has a paint layer and a mark layer on the external side of the cover 6, although these layers are not shown in the Figure. The golf ball 2 may have a rib positioned on the surface of the center 8.

This golf ball 2 has a diameter of from 40 mm to 45 mm. From the standpoint of conformity to a rule defined by United States Golf Association (USGA), the diameter is more preferably equal to or greater than 42.67 mm. In light of suppression of the air resistance, the diameter is more preferably equal to or less than 44 mm, and particularly preferably equal to or less than 42.80 mm. The weight of this golf ball 2 is 40 g or greater and 50 g or less. In light of attainment of great inertia, the weight is more preferably equal to or greater than 44 g, and particularly preferably equal to or greater than 45.00 g. From the standpoint of conformity to a rule defined by USGA, the weight is preferably equal to or less than 45.93 g.

The center 8 is obtained through crosslinking of a rubber composition. Illustrative examples of preferable base rubber include polybutadienes, polyisoprenes, styrene-butadiene copolymers, ethylene-propylene-diene copolymers and natural rubbers. In light of the resilience performance, polybutadienes are preferred. When other rubber is used in combination with polybutadiene, it is preferred that the polybutadiene is included as a principal component. Specifically, it is preferred that percentage of polybutadiene in the entire base rubber is equal to or greater than 50% by weight, and particularly equal to or greater than 80% by weight. Polybutadienes having a percentage of cis-1,4 bonds of equal to or greater than 40%, and particularly equal to or greater than 80% are preferred.

For crosslinking of the center 8, a co-crosslinking agent is preferably used. Preferable examples of the co-crosslinking agent in light of the resilience performance include monovalent or bivalent metal salts of an α,β-unsaturated carboxylic acid having 2 to 8 carbon atoms. Specific examples of the preferable co-crosslinking agent include zinc acrylate, magnesium acrylate, zinc methacrylate and magnesium methacrylate. Zinc acrylate and zinc methacrylate are particularly preferred on the grounds that a high resilience performance can be achieved.

As a co-crosslinking agent, an α,β-unsaturated carboxylic acid having 2 to 8 carbon atoms, and a metal oxide may be also blended. Both components react in the rubber composition to give a salt. This salt is responsible for the crosslinking reaction. Examples of preferable α,β-unsaturated carboxylic acid include acrylic acid and methacrylic acid. Examples of preferable metal oxide include zinc oxide and magnesium oxide.

In light of the resilience performance of the golf ball 2, the amount of the blended co-crosslinking agent is preferably equal to or greater than 10 parts by weight, and more preferably equal to or greater than 15 parts by weight per 100 parts by weight of the base rubber. In light of soft feel at impact, the amount of the blended co-crosslinking agent is preferably equal to or less than 50 parts by weight, and more preferably equal to or less than 45 parts by weight.

Preferably, the rubber composition for use in the center 8 includes organic peroxide together with the co-crosslinking agent. The organic peroxide serves as a crosslinking initiator. The organic peroxide can lead to achievement of excellent resilience performance of the golf ball 2. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide. Particularly versatile organic peroxide is dicumyl peroxide.

In light of the resilience performance of the golf ball 2, the amount of the blended organic peroxide is preferably equal to or greater than 0.1 parts by weight, more preferably equal to or greater than 0.3 parts by weight, and particularly preferably equal to or greater than 0.5 parts by weight per 100 parts by weight of the base rubber. In light of soft feel at impact, the amount of the blended organic peroxide is preferably equal to or less than 3.0 parts by weight, more preferably equal to or less than 2.8 parts by weight, and particularly preferably equal to or less than 2.5 parts by weight.

Preferably, the rubber composition for use in the center 8 includes an organic sulfur compound. Illustrative examples of preferable organic sulfur compound include mono-substituted forms such as diphenyl disulfide, bis(4-chlorophenyl) disulfide, bis(3-chlorophenyl)disulfide, bis(4-bromophenyl) disulfide, bis(3-bromophenyl)disulfide, bis(4-fluorophenyl) disulfide, bis(4-iodophenyl) disulfide, and bis(4-cyanophenyl)disulfide; di-substituted forms such as bis(2,5-dichlorophenyl) disulfide, bis(3,5-dichlorophenyl)disulfide, bis(2,6-dichlorophenyl)disulfide, bis(2,5-dibromophenyl) disulfide, bis(3,5-dibromophenyl)disulfide, bis(2-chloro-5-bromophenyl)disulfide, and bis(2-cyano-5-bromophenyl) disulfide; tri-substituted forms such as bis(2,4,6-trichlorophenyl)disulfide, and bis(2-cyano-4-chloro-6-bromophenyl)disulfide; tetra-substituted forms such as bis(2,3,5,6-tetrachlorophenyl)disulfide; and penta-substituted forms such as bis(2,3,4,5,6-pentachlorophenyl)disulfide, and bis(2,3,4,5,6-pentabromophenyl)disulfide. The organic sulfur compound can lead to achievement of excellent resilience performance of the golf ball 2. Particularly preferred organic sulfur compounds are diphenyl disulfide, and bis(pentabromophenyl) disulfide.

In light of the resilience performance of the golf ball 2, the amount of the blended organic sulfur compound is preferably equal to or greater than 0.1 parts by weight, and more preferably equal to or greater than 0.2 parts by weight per 100 parts by weight of the base rubber. In light of soft feel at impact, the amount of the blended organic sulfur compound is preferably equal to or less than 1.50 parts by weight, more preferably equal to or less than 1.0 parts by weight, and particularly preferably equal to or less than 0.8 parts by weight.

Into the center 8 may be blended a filler for the purpose of adjusting specific gravity and the like. Illustrative examples of suitable filler include zinc oxide, barium sulfate, calcium carbonate and magnesium carbonate. Powder of a highly dense metal may be also blended as the filler. Specific examples of the highly dense metal include tungsten and molybdenum. The amount of the blended filler is determined ad libitum so that the intended specific gravity of the center 8 can be accomplished. Particularly preferable filler is zinc oxide. Zinc oxide serves not only to adjust the specific gravity but also as a crosslinking activator. Various kinds of additives such as sulfur, an anti-aging agent, a coloring agent, a plasticizer, a dispersant and the like may be blended in an adequate amount to the center 8 as needed. Into the center 8 may be also blended crosslinked rubber powder or synthetic resin powder.

It is preferred that the center 8 has a diameter of 36 mm or greater and 42 mm or less. The golf ball 2 can achieve appropriate deformation owing to the center 8 having a diameter of equal to or greater than 36 mm. In this respect, the diameter is more preferably equal to or greater than 37 mm. The diameter set to be equal to or less than 42 mm can lead to contribution of the mid layer 10 and the cover 6 to the durability. In this respect, the diameter is more preferably equal to or less than 41 mm.

The amount of compressive deformation Cc of the center 8 is preferably 2.0 mm or greater and 5.0 mm or less. By the center 8 having the amount of compressive deformation Cc of equal to or greater than 2.0 mm, soft feel at impact of the golf ball 2 can be achieved. In this respect, the amount of compressive deformation Cc is more preferably equal to or greater than 2.4 mm, and particularly preferably equal to or greater than 2.6 mm. Owing to the center 8 having the amount of compressive deformation Cc of equal to or less than 5.0 mm, excellent resilience performance and durability of the golf ball 2 can be achieved. In this respect, the amount of compressive deformation Cc is more preferably equal to or less than 4.3 mm, and particularly preferably equal to or less than 3.5 mm.

Upon measurement of the amount of compressive deformation, a spherical body (i.e., center 8, core 4 or golf ball 2)

is first placed on a hard plate made of metal. Next, a cylinder made of metal gradually descends toward the spherical body. The spherical body intervened between the bottom face of the cylinder and the hard plate is deformed. A migration distance of the cylinder, starting from the state in which initial load of 98 N is applied to the spherical body up to the state in which final load of 1274 N is applied thereto is measured.

The mid layer 10 is constituted with a resin composition. Illustrative examples of preferable base resin for the resin composition include styrene block-containing thermoplastic elastomers, ionomer resins, thermoplastic polyurethane elastomers, thermoplastic polyester elastomers and thermoplastic polyamide elastomers.

Particularly preferable base resin is the styrene block-containing thermoplastic elastomer. This elastomer includes a polystyrene block as a hard segment, and a soft segment. Typical soft segment is a diene block. This elastomer may include a styrene-butadiene-styrene block copolymer (SBS), a styrene-isoprene-styrene block copolymer (SIS), a styrene-isoprene-butadiene-styrene block copolymer (SIBS), a hydrogenated product of SBS, a hydrogenated product of SIS or a hydrogenated product of SIBS. Exemplary hydrogenated product of SBS is a styrene-ethylene-butylene-styrene block copolymer (SEBS). Exemplary hydrogenated product of SIS is a styrene-ethylene-propylene-styrene block copolymer (SEPS). Exemplary hydrogenated product of SIBS is a styrene-ethylene-ethylene-propylene-styrene block copolymer (SEEPS).

In light of the resilience performance of the golf ball 2, the content of styrene component in the thermoplastic elastomer is preferably equal to or greater than 5% by weight, more preferably equal to or greater than 7% by weight, and particularly preferably equal to or greater than 10% by weight. In light of the feel at impact of the golf ball 2, the content is preferably equal to or less than 45% by weight, more preferably equal to or less than 40% by weight, and particularly preferably equal to or less than 35% by weight.

In the present invention, the styrene block-containing thermoplastic elastomer includes an alloy of olefin with one or more selected from the group consisting of SBS, SIS, SIBS, SEBS, SEPS and SEEPS, and hydrogenated products thereof. The olefin component in this alloy is speculated to contribute to improvement of the compatibility with other base polymer. When this alloy is used, the resilience performance of the golf ball 2 is improved. Preferably, olefin having 2 to 10 carbon atoms may be used. Illustrative examples of suitable olefin include ethylene, propylene, butene and pentene. Ethylene and propylene are particularly preferred.

Specific examples of the polymer alloy include "Rabalon® T3221C", "Rabalon® T3339C", "Rabalon® SJ4400N", "Rabalon® SJ5400N", "Rabalon® SJ6400N", "Rabalon® SJ7400N", "Rabalon® SJ8400N", "Rabalon® SJ9400N" and "Rabalon®SR04", trade names, available from Mitsubishi Chemical Corporation. Other specific examples of the styrene block-containing thermoplastic elastomer include "Epofriend® A1010", a trade name, available from Daicel Chemical Industries; and "Septon HG-252", a trade name, available from Kuraray Co., Ltd.

In light of the feel at impact, the material hardness of the styrene block-containing thermoplastic elastomer is preferably less than 8, more preferably less than 6, and particularly preferably less than 5. In the measurement of material hardness, a slab constituted with the styrene block-containing thermoplastic elastomer is used. In the present invention, unless otherwise specified in particular, the hardness may be measured in accordance with a standard of "ASTM-D 2240-68" by using a Shore D type hardness scale attached to an automated rubber hardness measuring device (trade name "P1", available from Koubunshi Keiki Co., Ltd.). For the measurement, a slab formed by hot pressing to have a thickness of about 2 mm is used. Prior to the measurement, the slab is stored at a temperature of 23° C. for two weeks. When the measurement is carried out, three pieces of the slab are overlaid. In measuring the material hardness of the styrene block-containing thermoplastic elastomer, a slab constituted with only the styrene block-containing thermoplastic elastomer is used. The material hardness as measured with a JIS-A spring type hardness scale is preferably less than 40, more preferably less than 30, and particularly preferably less than 20.

Together with the styrene block-containing thermoplastic elastomer, an ionomer resin, a thermoplastic polyurethane elastomer, a thermoplastic polyester elastomer or a thermoplastic polyamide elastomer may be also used. Together with the styrene block-containing thermoplastic elastomer, a polymer composition containing a lubricant may be also used.

The resin particularly suited for use in combination with the styrene block-containing thermoplastic elastomer is an ionomer resin. Examples of preferred ionomer resin include binary copolymers formed with α-olefin and an α,β-unsaturated carboxylic acid having 3 to 8 carbon atoms. Examples of preferable other ionomer resin include ternary copolymers formed with α-olefin, an α,β-unsaturated carboxylic acid having 3 to 8 carbon atoms and an α,β-unsaturated carboxylate ester having 2 to 22 carbon atoms. In the binary copolymer and ternary copolymer, preferable α-olefin is ethylene and propylene, and preferable α,β-unsaturated carboxylic acid is acrylic acid and methacrylic acid. In the binary copolymer and ternary copolymer, a part of the carboxyl groups may be neutralized with a metal ion. Illustrative examples of the metal ion for use in neutralization include sodium ion, potassium ion, lithium ion, zinc ion, calcium ion, magnesium ion, aluminum ion and neodymium ion. The neutralization may be carried out with two or more kinds of metal ions. Particularly suitable metal ion in light of the resilience performance and durability of the golf ball 2 is sodium ion, zinc ion, lithium ion and magnesium ion.

Preferable binary copolymer comprises 80% by weight or more and 90% by weight or less α-olefin, and 10% by weight or more and 20% by weight or less α,β-unsaturated carboxylic acid. This binary copolymer provides excellent resilience performance. Preferable ternary copolymer comprises 70% by weight or more and 85% by weight or less α-olefin, 5% by weight or more and 30% by weight or less α,β-unsaturated carboxylic acid, and 1% by weight or more and 25% by weight or less α,β-unsaturated carboxylate ester. This ternary copolymer provides excellent resilience performance. Particularly preferred ionomer resin is a copolymer formed with ethylene, and acrylic acid or methacrylic acid.

Specific examples of the ionomer resin include trade names "Himilan 1555", "Himilan 1557", "Himilan 1605", "Himilan 1706", "Himilan 1707", "Himilan 1856", "Himilan 1855", "Himilan AM7311", "Himilan AM7315", "Himilan AM7317", "Himilan AM7318" and "Himilan MK7320", available from Du Pont-MITSUI POLYCHEMICALS Co., Ltd.; trade names "Surlyn® 6120", "Surlyn® 6910", "Surlyn® 7930", "Surlyn® 7940", "Surlyn® 8140", "Surlyn® 8150", "Surlyn®8940", "Surlyn®8945", "Surlyn®9120", "Surlyn® 9150", "Surlyn® 9910", "Surlyn® 9945" and "Surlyn® AD8546", available from Du Pont Kabushiki Kaisha; and trade names "IOTEK 7010", "IOTEK 7030", "IOTEK 7510", "IOTEK 7520", "IOTEK 8000" and "IOTEK 8030", available from EXXON Mobil Chemical Corporation. Two or more kinds of the ionomer resins may be used in combination. An ionomer resin neutralized with a monovalent metal ion, and an ionomer resin neutralized with a bivalent metal ion may be used in combination.

In light of the resilience performance, the material hardness of the ionomer resin is preferably equal to or greater than 50, more preferably equal to or greater than 53, and particularly preferably equal to or greater than 55. In light of the feel at impact, the material hardness of the ionomer resin is preferably equal to or less than 70, more preferably equal to or less than 67, and particularly preferably equal to or less than 65. In measuring the material hardness of the ionomer resin, a slab constituted with only the ionomer resin is used.

When any other resin is used in combination with the styrene block-containing thermoplastic elastomer, proportion of the amount of the styrene block-containing thermoplastic elastomer per the amount of the entire base resin is preferably equal to or greater than 50% by weight, and more preferably equal to or greater than 70% by weight. The proportion may be 100% by weight.

Into the resin composition of the mid layer 10 may be blended a filler for the purpose of adjusting specific gravity and the like. Illustrative examples of suitable filler include zinc oxide, barium sulfate, calcium carbonate and magnesium carbonate. Powder of a highly dense metal may be also blended as the filler. This powder elevates the moment of inertia of the golf ball 2. The metal having a specific gravity of equal to or greater than 4.5 g/cm$^3$ is preferable; the metal having a specific gravity of equal to or greater than 5.0 g/cm$^3$ is more preferable; the metal having a specific gravity of equal to or greater than 7 g/cm$^3$ is further preferable; and the metal having a specific gravity of equal to or greater than 10 g/cm$^3$ is particularly preferable. Specific examples of the highly dense metal include tungsten and molybdenum. The amount of the filler is preferably equal to or greater than 5 parts by weight, more preferably equal to or greater than 10 parts by weight, and particularly preferably equal to or greater than 15 parts by weight per 100 parts by weight of the base resin. The amount of the filler is preferably equal to or less than 30 parts by weight. Into the mid layer 10 may be also blended a coloring agent, crosslinked rubber powder or synthetic resin powder.

The hardness (shore D) of the mid layer 10 is preferably less than 35. Owing to the mid layer 10 having a hardness of less than 35, appropriate deformation of the golf ball 2 can be achieved. In this respect, the hardness is more preferably equal to or less than 34, and particularly preferably equal to or less than 30. The hardness is preferably equal to or greater than 1, and particularly preferably equal to or greater than 3. For the measurement of the hardness, a slab constituted with a resin composition that is the same as the resin composition of the mid layer 10 is used. Details of the method for measurement are as described above.

In light of appropriate deformation of the golf ball 2, the thickness of the mid layer 10 is preferably equal to or greater than 0.3 mm, and more preferably equal to or greater than 0.5 mm. In light of the resilience performance of the golf ball 2, the thickness is preferably equal to or less than 1.2 mm, and more preferably equal to or less than 1.1 mm.

The cover 6 is constituted with a resin composition. Preferable base resin of the resin composition is an ionomer resin. The ionomer resin similar to those described above in connection with the mid layer 10 can be used for the cover 6. The ionomer resin is responsible for the resilience performance of the golf ball 2. In the cover 6, a styrene block-containing thermoplastic elastomer, a thermoplastic polyester elastomer, a thermoplastic polyamide elastomer, a thermoplastic polyurethane elastomer or a thermoplastic polyolefin elastomer may be also used. The ionomer resin and other resin may be used in combination. When they are used in combination, the ionomer resin is preferably included as a principal component in light of the resilience performance. The proportion of the ionomer resin in the total amount of the base resin is preferably equal to or greater than 70% by weight, and more preferably equal to or greater than 80%.

The cover 6 has a hardness (Shore D) of preferably equal to or greater than 55. This cover 6 can serve in achieving excellent resilience performance of the golf ball 2. In this respect, the hardness is more preferably equal to or greater than 60, and particularly preferably equal to or greater than 65. In light of the feel at impact, the hardness is preferably equal to or less than 75, and more preferably equal to or less than 70. For the measurement, a slab constituted with a resin composition that is the same as the resin composition of the cover 6 is used. Details of the method for measurement are as described above.

The cover 6 has a thickness of preferably 0.8 mm or greater and 1.4 mm or less. Owing to the cover 6 having a thickness of equal to or greater than 0.8 mm, excellent flight performance and durability can be achieved. In this respect, the thickness is more preferably equal to or greater than 1.0 mm. Owing to the cover 6 having a thickness of equal to or less than 1.4 mm, appropriate deformation of the core 4 can be achieved. In this respect, the thickness is more preferably equal to or less than 1.3 mm. The cover 6 may have two or more layers.

Into the cover 6 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed. The cover 6 may be also blended with powder of a highly dense metal such as tungsten, molybdenum or the like for the purpose of adjusting the specific gravity.

The amount of compressive deformation Cb of the golf ball 2 is preferably 2.0 mm or greater and 5.0 mm or less. The golf ball 2 having the amount of compressive deformation Cb of equal to or greater than 2.0 mm is excellent in the feel at impact. In this respect, the amount of compressive deformation Cb is more preferably equal to or greater than 2.4 mm, and particularly preferably equal to or greater than 2.6 mm. The golf ball 2 having the amount of compressive deformation Cb of equal to or less than 5.0 mm is excellent in the durability. In this respect, the amount of compressive deformation Cb is more preferably equal to or less than 4.3 mm, and particularly preferably equal to or less than 3.5 mm.

In light of the resilience performance and durability, the difference (Cc−Cb) between the amount of compressive deformation Cc of the center 8 and the amount of compressive deformation Cb of the golf ball 2 is preferably equal to or greater than 0.4 mm, and particularly preferably equal to or greater than 0.5 mm. In light of the feel at impact, the difference (Cc−Cb) is more preferably equal to or less than 1.2 mm, and particularly preferably equal to or less than 1.0 mm.

The resilience coefficient Ec of the center 8, the resilience coefficient Em of the core 4, and the resilience coefficient Eb of the golf ball 2 satisfy the following formula (1):

$$Eb \geqq Ec \geqq Em \quad (1).$$

In this golf ball 2, the resilience coefficient Ec of the center 8 is the same as or greater than the resilience coefficient Em of the core 4, and the resilience coefficient Eb of the golf ball 2 is the same as or greater than the resilience coefficient Ec of the center 8. The gradient of the resilience coefficient from the center 8 to the core 4 may be either zero or negative, while the gradient of the resilience coefficient from the core 4 to the golf ball 2 may be either zero or positive. Great distortion is generated when this golf ball 2 is hit, even though just a low head speed is attained. Resulting from this distortion, the center 8 greatly contributes to the initial speed of the golf ball 2. In addition, since the resilience coefficient Ec is equivalent to or less than the resilience coefficient Eb, large energy loss in the center 8 may be yielded upon hitting with a driver. Spin may be suppressed due to the large energy loss. Superior flight performance is achieved owing to the great initial speed and low spin.

In measuring the resilience coefficient, an aluminum hollow cylinder having a mass of 200 g is allowed to impact onto a spherical body (golf ball 2, core 4 or center 8) at a velocity of 40 m/s. Then, velocity of the hollow cylinder prior to and after the impact, and the velocity of the spherical body after the impact are measured to determine the resilience coefficient of the spherical body. Results obtained by 12 times measurement are averaged.

Preferably, the golf ball 2 satisfies the following formula (6):

$$Eb>Ec>Em \quad (6).$$

The gradient of the resilience coefficient from the center 8 to the core 4 is negative, while the gradient of the resilience coefficient from the core 4 to the golf ball 2 is positive in the golf ball 2 that satisfies the above formula (6). Great distortion is generated when this golf ball 2 is hit, even though just a low head speed is attained. This golf ball 2 is extremely excellent in the flight performance.

Preferably, the golf ball 2 satisfies the following formula (2):

$$Eb-Ec \geqq Ec-Em \quad (2).$$

The cover 6 is responsible for the resilience performance in this golf ball 2. This golf ball 2 is excellent in the flight performance. More preferably, the golf ball 2 satisfies the following formula (7):

$$Eb-Ec>Ec-Em \quad (7).$$

The golf ball 2 that satisfies the above formula (7) is extremely excellent in the flight performance.

It is preferred that the difference (Eb−Ec) between the resilience coefficient Eb and the resilience coefficient Ec be equal to or greater than 0.004. According to the golf ball 2 having the difference (Eb−Ec) of equal to or greater than 0.004, the cover 6 can be responsible for the resilience performance. In this respect, the difference (Eb−Ec) is more preferably equal to or greater than 0.006, and particularly preferably equal to or greater than 0.008. The difference (Eb−Ec) is preferably equal to or less than 0.03.

The difference (Ec−Em) between the resilience coefficient Ec and the resilience coefficient Em is preferably equal to or greater than 0.004. According to the golf ball 2 having the difference (Ec−Em) of equal to or greater than 0.004, the center 8 can be greatly deformed upon hitting. In this respect, the difference (Ec−Em) is more preferably equal to or greater than 0.006, and particularly preferably equal to or greater than 0.008. The difference (Ec−Em) is preferably equal to or less than 0.03.

Figure 2:
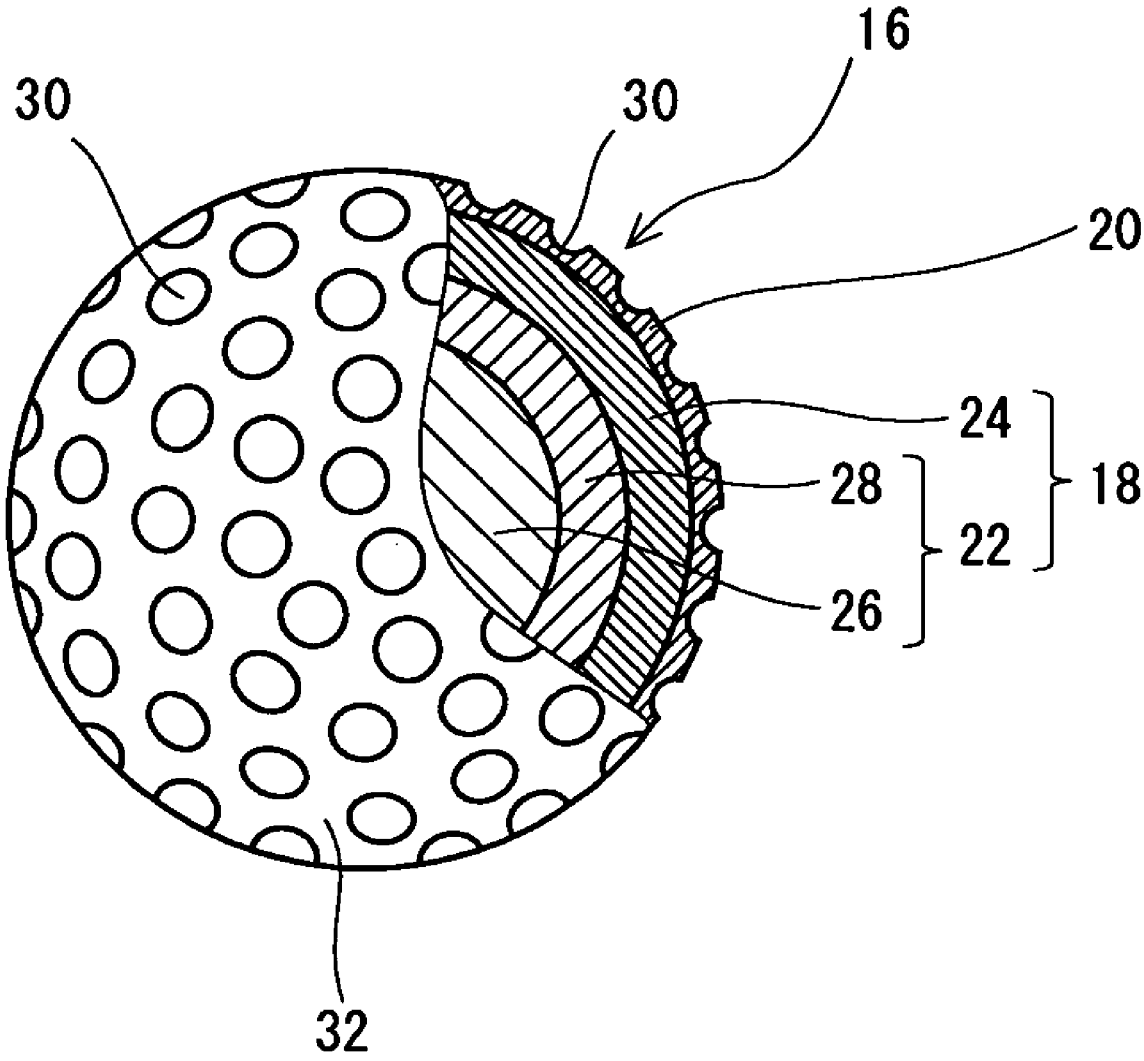
FIG. 2 shows a schematic cross-sectional view illustrating a golf ball according to another embodiment of the present invention.

FIG. 2 shows a schematic cross-sectional view illustrating golf ball 16 according to another embodiment of the present invention. This golf ball 16 has spherical core 18, and cover 20 provided so as to cover this core 18. The core 18 has spherical center 22, and mid layer 24 provided so as to cover this center 22. The center 22 consists of spherical first layer 26, and second layer 28 positioned outside this first layer 26. Numerous dimples 30 are formed on the surface of the cover 20. Of the surface of the golf ball 16, a part other than the dimples 30 is land 32. This golf ball 16 has a paint layer and a mark layer on the external side of the cover 20, although these layers are not shown in the Figure. The constitution of the mid layer 24 is the same as the constitution of the mid layer 10 of the golf ball 2 shown in FIG. 1. The constitution of the cover 20 is the same as the constitution of the cover 6 of the golf ball 2 shown in FIG. 1. The golf ball 16 may have a rib positioned on the surface of the first layer 26.

The first layer 26 and the second layer 28 are obtained through crosslinking of a rubber composition. The rubber composition that is the equivalent to the composition for use in the center 8 of the golf ball 2 shown in FIG. 1 can be used for the first layer 26 and the second layer 28. The diameter of the first layer 26 is preferably 5 mm or greater and 30 mm or less. The second layer 28 has a thickness of preferably 4 mm or greater and 16.4 mm or less.

This golf ball 16 satisfies the above formula (1). Great distortion is generated when this golf ball 16 is hit, even though just a low head speed is attained. Resulting from this distortion, the center 22 greatly contributes to the initial speed of the golf ball 16. In addition, since the resilience coefficient Ec is equivalent to or less than the resilience coefficient Eb, large energy loss in the center 22 may be yielded upon hitting with a driver. Spin may be suppressed due to the large energy loss. Superior flight performance is achieved owing to the great initial speed and low spin. Preferably, this golf ball 16 satisfies the above formula (2), (6) or (7).

The difference (Eb−Ec) between the resilience coefficient Eb and the resilience coefficient Ec is equal to or greater than 0.004, more preferably equal to or greater than 0.006, and particularly preferably equal to or greater than 0.008. The difference (Eb−Ec) is preferably equal to or less than 0.03. The difference (Ec−Em) between the resilience coefficient Ec and the resilience coefficient Em is preferably equal to or greater than 0.004, more preferably equal to or greater than 0.006, and particularly preferably equal to or greater than 0.008. The difference (Ec−Em) is preferably equal to or less than 0.03.

The resilience coefficient Ec1 of the first layer 26, and the resilience coefficient Ec of the center 22 satisfy the following formula (3):

$$Ec>Ec1 \quad (3).$$

According to this golf ball 16, the center 22 is sufficiently deformed upon hitting. Great initial speed is attained when this golf ball 16 is hit with a low head speed. This golf ball 16 is excellent in the flight performance.

Preferably, the golf ball 16 satisfies the formula (4) or (5):

$$Eb \geqq Ec \geqq Em > Ec1 \quad (4);$$

$$Eb \geqq Ec > Em \geqq Ec1 \quad (5).$$

In the golf ball 16 which satisfies the formula (4) or (5), extremely great deformation of the center 22 is achieved upon hitting. In light of the deformation of center 22, it is more preferred that the golf ball 16 satisfies the following formula (8):

$$Eb \geqq Ec > Em > Ec1 \quad (8).$$

EXAMPLES

Example 1

A rubber composition (a) was obtained by kneading 100 parts by weight of high-cis polybutadiene (trade name "BR- 730" available from JSR Corporation), 28 parts by weight of zinc diacrylate, 10 parts by weight of zinc oxide, an adequate amount of barium sulfate, 0.3 parts by weight of bis(pentabromophenyl)disulfide and 0.7 parts by weight of dicumyl peroxide (NOF Corporation). This rubber composition (a) was placed into a mold having upper and lower mold half each having a hemispherical cavity, and heated at 170° C. for 30 minutes to obtain a center having a diameter of 38.3 mm. On the other hand, 20 parts by weight of an ionomer resin ("Himilan 1605", available from Du Pont-MITSUI POLYCHEMICALS Co., Ltd.), 20 parts by weight of other ionomer resin ("Himilan 1706", available from Du Pont-MITSUI POLYCHEMICALS Co., Ltd.) 60 parts by weight of a styrene block-containing thermoplastic elastomer (KRAIBURG TPE GmbH) and 15 parts by weight of tungsten powder were kneaded in a twin screw kneading extruder to obtain a resin composition (f). This resin composition (f) was rendered to cover around the center by injection molding to obtain a core consisting of the center and a mid layer. The mid layer had a thickness of 1.0 mm. Furthermore, 50 parts by weight of an ionomer resin (trade name "Surlyn® 8140" available from Du Pont Kabushiki Kaisha), 50 parts by weight of other ionomer resin (trade name "Surlyn® 9120" available from Du Pont Kabushiki Kaisha) and 2 parts by weight of titanium dioxide were kneaded in a twin screw kneading extruder to obtain a resin composition (q). The aforementioned core was placed into a final mold having numerous pimples on the inside face, followed by injection of the aforementioned resin composition (q) around the core by injection molding to form a cover. The cover had a thickness of 1.2 mm. Numerous dimples having a shape inverted from the shape of the pimple were formed on the cover. A clear paint including a two-part liquid curable polyurethane as a base was applied on this cover to give a golf ball of Example 1 having a diameter of 42.7 mm and a weight of about 45.4 g.

Examples 2 to 5 and Comparative Examples 1 to 3

Golf balls of Examples 2 to 5 and Comparative Examples 1 to 3 were obtained in a similar manner to Example 1 except that specifications of the center, the mid layer and the cover were as listed in Tables 4 and 5 below. Details of the rubber composition of the center are presented in Table 1 below. Details of the resin composition of the mid layer are presented in Table 2 below. Details of the resin composition of the cover are presented in Table 3 below.

Example 6

A rubber composition (c) was obtained by kneading 100 parts by weight of high-cis polybutadiene ("BR-730", supra), 19 parts by weight of zinc diacrylate, 10 parts by weight of zinc oxide, 0.3 parts by weight of bis(pentabromophenyl) disulfide and 0.7 parts by weight of dicumyl peroxide. This rubber composition (c) was placed into a mold having upper and lower mold half each having a hemispherical cavity, and heated at 170° C. for 30 minutes to obtain a first layer having a diameter of 18.0 mm. A rubber composition (b) was obtained by kneading 100 parts by weight of high-cis polybutadiene ("BR-730", supra), 32 parts by weight of zinc diacrylate, 10 parts by weight of zinc oxide, an adequate amount of barium sulfate, 0.3 parts by weight of bis(pentabromophenyl)disulfide and 0.7 parts by weight of dicumyl peroxide (NOF Corporation). Half shells were formed with this rubber composition (b). The first layer was covered by two half shells. The first layer and half shells were placed into a mold having upper and lower mold half each having a hemispherical cavity, and heated at 170° C. for 20 minutes to obtain a center having a diameter of 38.3 mm. On the other hand, 20 parts by weight of an ionomer resin ("Himilan 1605", supra), 20 parts by weight of other ionomer resin ("Himilan 1706", supra) 60 parts by weight of a styrene block-containing thermoplastic elastomer (KRAIBURG TPE GmbH) and 15 parts by weight of tungsten powder were kneaded in a twin screw kneading extruder to obtain a resin composition (f). This resin composition (f) was rendered to cover around the center by injection molding to obtain a core consisting of the center and a mid layer. The mid layer had a thickness of 1.0 mm. Furthermore, 50 parts by weight of an ionomer resin ("Surlyn® 8140", supra), 50 parts by weight of other ionomer resin ("Surlyn® 9120", supra) and 2 parts by weight of titanium dioxide were kneaded in a twin screw kneading extruder to obtain a resin composition (q). The aforementioned core was placed into a final mold having numerous pimples on the inside face, followed by injection of the aforementioned resin composition (q) around the core by injection molding to form a cover. The cover had a thickness of 1.2 mm. Numerous dimples having a shape inverted from the shape of the pimple were formed on the cover. A clear paint including a two-part liquid curable polyurethane as a base was applied on this cover to give a golf ball of Example 6 having a diameter of 42.7 mm and a weight of about 45.4 g.

Flight Distance Test

A driver with a titanium head (trade name "XXIO", available from SRI Sports Limited, shaft hardness: R, loft angle: 11°) was attached to a swing machine, available from Golf Lab Co., Ltd. The golf ball was hit under the condition to provide a head speed of 40 m/sec. Accordingly, the distance from the launching point to the point where the ball stopped was measured. Mean values of data obtained by the measurement of 12 times are presented in Tables 4 and 5 below.

Evaluation of Feel at Impact

The golf balls were hit with driver by ten golf players, who then evaluated the feel at impact. Based on the number of the golf player(s) who evaluated that "feel at impact is superior", the following grading was made:

A: eight or more;

B: six or seven;

C: four or five; and

D: three or less.

The results are presented in Tables 4 and 5 below.

TABLE 1

Rubber Composition of Center (parts by weight)

| Type | a | b | c |
|---|---|---|---|
| Polybutadiene | 100 | 100 | 100 |
| Zinc diacrylate | 28 | 32 | 19 |
| Zinc oxide | 10 | 10 | 10 |
| Barium sulfate *1 | adequate amount | adequate amount | — |
| Bis(pentabromophenyl)disulfide | 0.3 | 0.3 | 0.3 |
| Dicumyl peroxide | 0.7 | 0.7 | 0.7 |

*1 Adjust to provide the golf ball having a mass of 45.4 g

TABLE 2

Resin Composition of Mid Layer (parts by weight)

| Type | f | g | h | i | j | k |
|---|---|---|---|---|---|---|
| Ionomer resin *2 | 20 | 20 | — | 35 | — | — |
| Ionomer resin *3 | 20 | 20 | — | 30 | — | — |
| Thermoplastic polystyrene elastomer *4 | — | 60 | — | 35 | — | 100 |
| Thermoplastic polystyrene elastomer *5 | 60 | — | — | — | — | — |
| Thermoplastic polyurethane elastomer *6 | — | — | 100 | — | — | — |
| Thermoplastic polyurethane elastomer *7 | — | — | — | — | 100 | — |
| Tungsten powder | 15 | 15 | 15 | — | — | — |

*2 Himilan 1605
*3 Himilan 1706
*4 Rabalon T3221C, material hardness: 20 (JIS-A)
*5 KRAIBURG TPE GmbH, material hardness: 10 (JIS-A)
*6 BASF Japan Ltd., material hardness: 80 (JIS-A)
*7 "XNY97A" of BASF Japan Ltd., material hardness: 97 (JIS-A)

TABLE 3

Resin Composition of Cover (parts by weight)

| | p | q | r | s | t |
|---|---|---|---|---|---|
| Ionomer resin *8 | 50 | — | 50 | — | 50 |
| Ionomer resin *9 | 47 | — | 50 | — | 42 |
| Thermoplastic polystyrene elastomer *4 | 3 | — | — | — | 8 |
| Ionomer resin *10 | — | 50 | — | — | — |
| Ionomer resin *11 | — | 50 | — | — | — |
| Thermoplastic polyurethane elastomer *7 | — | — | — | 100 | — |
| Titanium dioxide | 2 | 2 | 2 | 2 | 2 |

*8 Surlyn ® 8945
*9 Himilan 7329
*10 Surlyn ® 8140
*11 Surlyn ® 9120

TABLE 4

Evaluation Results

| | | Example 1 | Example 2 | Example 3 | Example 4 | Example 5 |
|---|---|---|---|---|---|---|
| First layer | Composition type | — | — | — | — | — |
| | Diameter (mm) | — | — | — | — | — |
| | Amount of compressive deformation (mm) | — | — | — | — | — |
| | Resilience coefficient Ec1 | — | — | — | — | — |
| Composition type of center or second layer | | a | b | a | b | b |
| Center | Diameter (mm) | 38.3 | 38.3 | 38.3 | 38.3 | 38.3 |
| | Amount of compressive deformation (mm) | 3.4 | 3.0 | 3.4 | 3.0 | 3.4 |
| | Resilience coefficient Ec | 0.790 | 0.796 | 0.790 | 0.796 | 0.790 |
| Mid layer | Composition type | f | g | h | g | k |
| | Hardness (Shore D) | 20 | 30 | 25 | 30 | 6 |
| | Thickness (mm) | 1.0 | 1.0 | 1.0 | 1.0 | 1.0 |
| Core | Resilience coefficient Em | 0.782 | 0.792 | 0.784 | 0.792 | 0.774 |
| Cover | Composition type | q | p | r | t | q |
| | Hardness (Shore D) | 68 | 61 | 64 | 59 | 68 |
| | Thickness (mm) | 1.2 | 1.2 | 1.2 | 1.2 | 1.2 |
| Ball | Amount of compressive deformation (mm) | 2.7 | 2.6 | 2.8 | 2.6 | 2.8 |
| | Resilience coefficient Eb | 0.811 | 0.807 | 0.808 | 0.802 | 0.807 |
| Ec − Em | | 0.008 | 0.004 | 0.006 | 0.004 | 0.016 |
| Eb − Ec | | 0.021 | 0.011 | 0.018 | 0.006 | 0.017 |
| Eb > Ec > Em | | Yes | Yes | Yes | Yes | Yes |
| Eb − Ec > Ec − Em | | Yes | Yes | Yes | Yes | Yes |
| Eb > Ec > Em > Ec1 | | — | — | — | — | — |
| Flight distance (m) | | 196.5 | 194.5 | 195.5 | 194.0 | 197.0 |
| Feel at impact | | A | A | A | A | A |

TABLE 5

Evaluation Results

| | | Example 6 | Compara. Example 1 | Compara. Example 2 | Compara. Example 3 |
|---|---|---|---|---|---|
| First layer | Composition type | c | — | — | — |
| | Diameter (mm) | 18 | — | — | — |
| | Amount of compressive deformation (mm) | 5.2 | — | — | — |
| | Resilience coefficient Ec1 | 0.774 | — | — | — |
| Composition type of center or second layer | | b | a | b | b |
| Center | Diameter (mm) | 38.3 | 38.3 | 38.3 | 38.3 |
| | Amount of compressive deformation (mm) | 3.4 | 3.4 | 3.0 | 3.0 |
| | Resilience coefficient Ec | 0.796 | 0.790 | 0.796 | 0.796 |

TABLE 5-continued

| Evaluation Results | | | | | |
|---|---|---|---|---|---|
| | | Example 6 | Compara. Example 1 | Compara. Example 2 | Compara. Example 3 |
| Mid layer | Composition type | f | i | j | g |
| | Hardness (Shore D) | 20 | 45 | 48 | 30 |
| | Thickness (mm) | 1.0 | 1.0 | 1.0 | 1.0 |
| Core | Resilience coefficient Em | 0.786 | 0.791 | 0.799 | 0.792 |
| Cover | Composition type | q | t | q | s |
| | Hardness (Shore D) | 68 | 59 | 68 | 48 |
| | Thickness (mm) | 1.2 | 1.2 | 1.2 | 1.2 |
| Ball | Amount of compressive deformation (mm) | 2.6 | 2.9 | 2.3 | 2.9 |
| | Resilience coefficient Eb | 0.816 | 0.804 | 0.814 | 0.783 |
| Ec − Em | | 0.010 | −0.001 | −0.003 | 0.004 |
| Eb − Ec | | 0.020 | 0.014 | 0.018 | −0.013 |
| Eb > Ec > Em | | Yes | No | No | No |
| Eb − Ec > Ec − Em | | Yes | Yes | Yes | No |
| Eb > Ec > Em > Ec1 | | Yes | — | — | — |
| Flight distance (m) | | 198.0 | 194.0 | 197.0 | 191.0 |
| Feel at impact | | A | B | C | B |

As shown in Tables 4 and 5, the golf ball of each Example is excellent in the flight performances. Therefore, advantages of the present invention are clearly suggested by these results of evaluation.

The golf ball according to the present invention can be used for the play at the golf course, and exercises in the driving range. The description herein above is merely for illustrative examples, and various modifications can be made without departing from the principles of the present invention.

What is claimed is:

1. A golf ball which comprises a core and a cover positioned outside the core, the core having a center and a mid layer positioned outside the center, wherein the resilience coefficient Ec of the center, the resilience coefficient Em of the core and the resilience coefficient Eb of the golf ball satisfy the following formula (1):

$$Eb \geqq Ec \geqq Em \quad (1),$$

the center comprises a first layer and a second layer positioned outside the first layer, the resilience coefficient Ec1 of the first layer and the resilience coefficient Ec of the center satisfy the following formula (3):

$$Ec > Ec1 \quad (3), \text{ and}$$

the following formula (4) or (5) is satisfied:

$$Eb \geqq Ec \geqq Em > Ec1 \quad (4);$$

$$Eb \geqq Ec > Em \geqq Ec1 \quad (5).$$

* * * * *